US005456367A

United States Patent [19]

Beukeveld

[11] Patent Number: 5,456,367

[45] Date of Patent: Oct. 10, 1995

[54] BICYCLE STORAGE APPARATUS

[76] Inventor: Petrus J. Beukeveld, Ransdalerstraat 27, NL-6311 AW Ransdaal, Netherlands

[21] Appl. No.: 162,058

[22] PCT Filed: Jun. 10, 1992

[86] PCT No.: PCT/NL92/00100

§ 371 Date: Apr. 12, 1994

§ 102(e) Date: Apr. 12, 1994

[87] PCT Pub. No.: WO92/22718

PCT Pub. Date: Dec. 23, 1992

[51] Int. Cl.[6] ..... A47F 5/00

[52] U.S. Cl. ..... 211/22

[58] Field of Search ..... 211/22, 17, 20, 211/5, 1.55, 163

[56] References Cited

U.S. PATENT DOCUMENTS 3,907,114 9/1975 Ewers ..... 211/22

FOREIGN PATENT DOCUMENTS 92498 11/1896 Germany ..... 211/22

105950 2/1899 Germany .

103654 4/1898 Ireland ..... 211/22

6501477 8/1966 Netherlands ..... 211/22

*Primary Examiner*—Ramon O. Ramirez

*Assistant Examiner*—Sarah L. Purol

*Attorney, Agent, or Firm*—David P. Gordon

[57] ABSTRACT

The invention relates to a bicycle storage place in which within a wall (1) with a lockable doorway (3) a plurality of bicycles with their rear wheels directed towards the central axis (59) are lined up in bicycle holders (9) in two concentric rows (5, 7) on a frame (23) rotatable around a central axis (59). The handlebars of the bicycles in one row (5) extend into the space taken up by the adjacent bicycles of the other row (7). For radially removing a bicycle fastened to its holder (9) through the doorway (3), holders (51, 53) on either one of the two sides of a particular holder (49) are temporarily moved apart by their ends axially directed outwards and counteracting the working of the leaf springs (43 and 45), so that the holder (49) with the bicycle fastened thereon can be moved freely through the doorway (3).

20 Claims, 3 Drawing Sheets

BICYCLE STORAGE APPARATUS

BACKGROUND OF THE INVENTION

1. Field of the Invention

The invention relates to a bicycle storage apparatus, having a rotatable frame which includes a plurality of holders extending radially relative to a central axis, in which the bicycles with their front wheels directed outwards can be fastened and where the frame is surrounded by a wall which comprises a lockable doorway for radially inserting and removing a bicycle. With such a storage apparatus it is possible by means of a protective lockable doorway to prevent bicycles being stolen which are temporarily left behind by users. This storage apparatus can be found at places where there is a large supply of bicycles.

2. State of the Art

A first prior art bicycle storage apparatus, such as is seen in DE-OS 105.950, has radially arranged bicycle holders. A bicycle is inserted with the rear wheel directed towards a central axis, so that the narrower rear part of the bicycle is located near the central axis and the handlebars having the largest cross dimension of the bicycle are located near a position radially extending outwards.

The first prior art storage apparatus is utilized more efficiently than other prior art bicycle lockups, in which the bicycles are stored parallel with each other in concatenated lockup sections, because storing a specific number of bicycles requires a smaller area. In the first prior art bicycle storage apparatus, the width of the handlebars of the bicycles arranged in a circle around the central axis determines the maximum number of bicycles to be stored per unit area. Also of importance, is that the handlebars of the bicycles do not catch or touch one another and remain apart, so that a selected bicycle could be removed radially from the holders.

SUMMARY OF THE INVENTION

It is an object of the invention to provide a bicycle storage apparatus, in which the number of bicycles to be stored per unit area may be considerably increased.

For this purpose, the bicycle storage apparatus of the invention includes holders coupled to a circular frame which arrange the bicycles in two concentric rows, the bicycles being alternately located in one or the other row. The holders on either side of the holder located opposite to the doorway, at their ends remote from the frame center, are capable of moving transversely in a reciprocating manner to counteract a spring force, so that a bicycle on the holder located in front of the doorway can be moved unimpededly axially to or from a more inwardly located row of bicycles between the bicycles standing on either side of the bicycle.

By arranging the bicycles in two concentric rows, a highly compact storage is possible, while the handlebars of adjacent bicycles cannot touch one another.

According to a preferred embodiment the frame is rotatable around a central axis and, furthermore, a drive arrangement is present for causing the bicycle holders to rotate around this axis. The drive arrangement is coupled to a control arrangement which, upon receiving commands to move the drive, controls the drive arrangement so that the drive arrangement rotates the desired bicycle holder opposite the doorway and then unlocks the door.

It should further be observed that more storage apparatus units, for example, six rotating frames, can be accommodated in one common space which is accessible through a single well-secured door. In addition, these storage apparatus units each comprising a rotatable frame can be used in two parallel rows of contiguous units, between which rows there is a common corridor.

When a square surrounding wall is used, one side of which is bordering on the corridor, the entrance door is positioned in the middle of this side. If a plurality of such units are arranged side by side, the partition walls perpendicular to the corridor between the adjacent units may be omitted and the pairs of walls running parallel with the corridor can be arranged as two walls extending along the units. In this case a unit is obtained, constituted by a plurality of groups of radial bicycle holders which are rotatable per group around a central axis, the plurality of groups being surrounded by a rectangular wall.

It should be appreciated that different configurations are likewise possible, such as four groups whose central axes are located at the angular points of a square.

DETAILED DESCRIPTION OF THE PREFERRED EMBODIMENT

Figure 1:
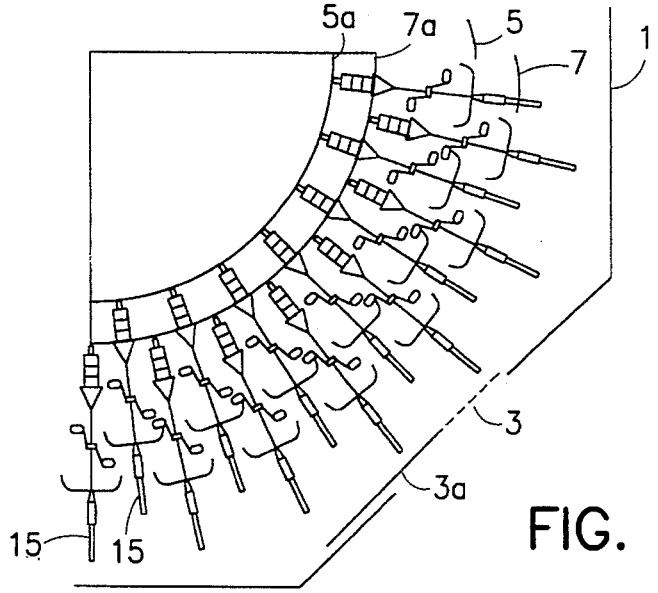
FIG. 1 shows a quarter section of a top view of an octagonal storage apparatus, the bicycles being arranged in two concentric circles.

The storage apparatus shown in FIG. 1 and octagonal in this example, includes a wall 1 behind which are placed two concentric rows of bicycles. The wall 1 has a doorway 3 to be shut off by way of a lockable door 3*a*. The first row 5*a* is formed by bicycles referenced 5; the second row 7*a* located outside the first row 5*a*, viewed radially, comprises bicycles referenced 7. All the bicycles are directed with their front wheels towards the wall 1. In this manner adjacent bicycles can be stored away in a highly compact manner, without the handlebars of the bicycles stored next to one another touching.

Figure 3:
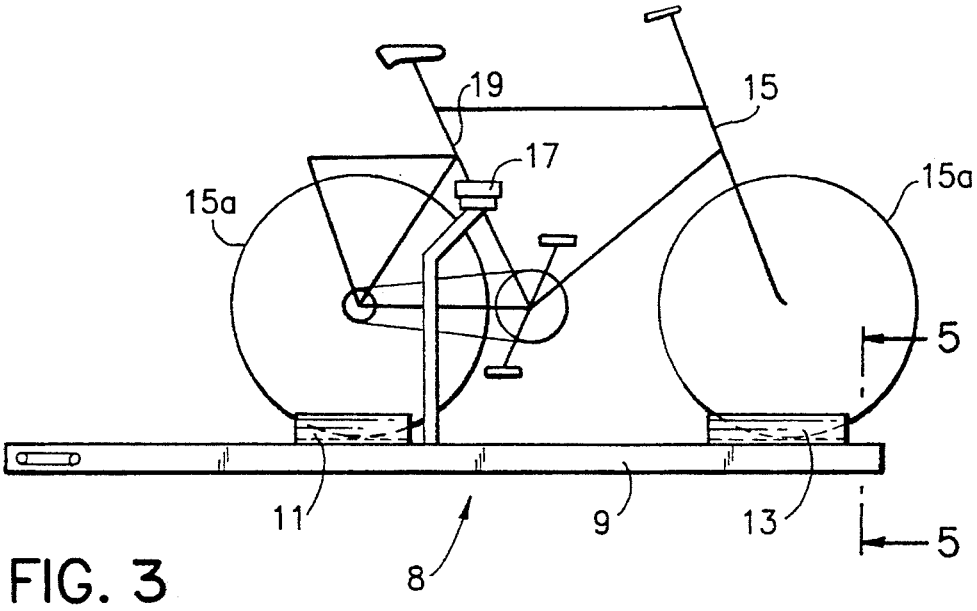
FIG. 3 shows a side view of a tubular bicycle holder carrying a bicycle.
Figure 4:
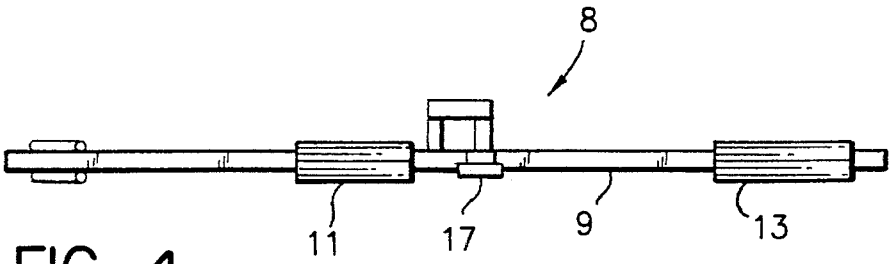
FIG. 4 shows a top view of the holder as shown in FIG. 3.
Figure 5:
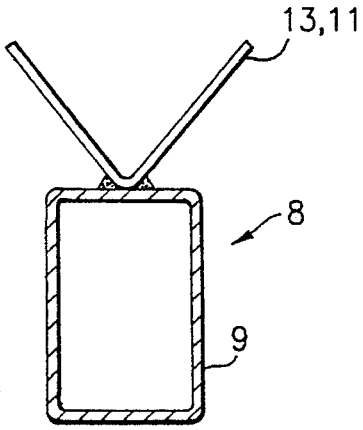
FIG. 5 shows a cross-sectional view along 5—5 of the holder as shown in FIGS. 3 and 4.

Each bicycle holder 8 is formed as a rectangular profiled tube 9 (FIG. 5) to which two wheel gutters 11 and 13 are preferably welded. A bicycle 15 with its tires 15*a* placed in the wheel gutters, can be locked to the holder by means of a clamp 17 of known construction. This clamp engages with a rod 19 of the bicycle frame (FIGS. 3 and 4). All the holders 8 are identical, except for the locations of the gutters 13, 15 and of the clamp 17.

A frame 23 which is rotatable around a central axis 59 (FIG. 2) by means of a drive (not shown) is disposed at a central position in the storage apparatus. This frame 23 includes radially protruding pins 25 rigidly attached to vertical leaf springs 27 which themselves are coupled to the frame 23. The pins 25 fit within each of the tubes 9 of the holders and are capable of rotating the bicycle holders 8 around the central axis 59 as the frame 23 rotates around the central axis 59.

The frame 23 also includes electromotors with reduction gearboxes for driving the rotatable frame and for performing the further mechanical operations. In addition, an operating panel is available for inputting commands which provide that the correct holder is turned towards the entrance, that the entrance door is opened or closed, and that the bicycle is moved radially through the doorway 3. For this purpose, a computer may be used which stores the necessary information in its memory. Various constructions for the drive arrangement and the operating panel may be used which are known per se from control and automation technology and are beyond the scope of the present invention. Therefore, the drive arrangement and the operating panel are not represented in the Figures.

Figure 6:
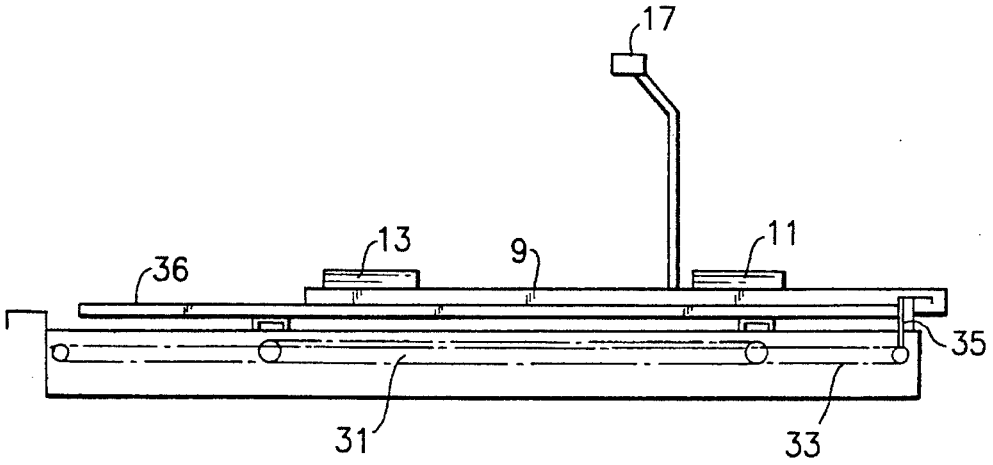
FIG. 6 shows a mechanism for moving the holder radially in a longitudinal direction.

Furthermore, a chain mechanism 31 (FIG. 6) is available for moving the tube 9 radially through the doorway. A chain 33 of the chain mechanism 31 is connected to a coupling element 35 cooperating with the tube 9.

Figure 7:
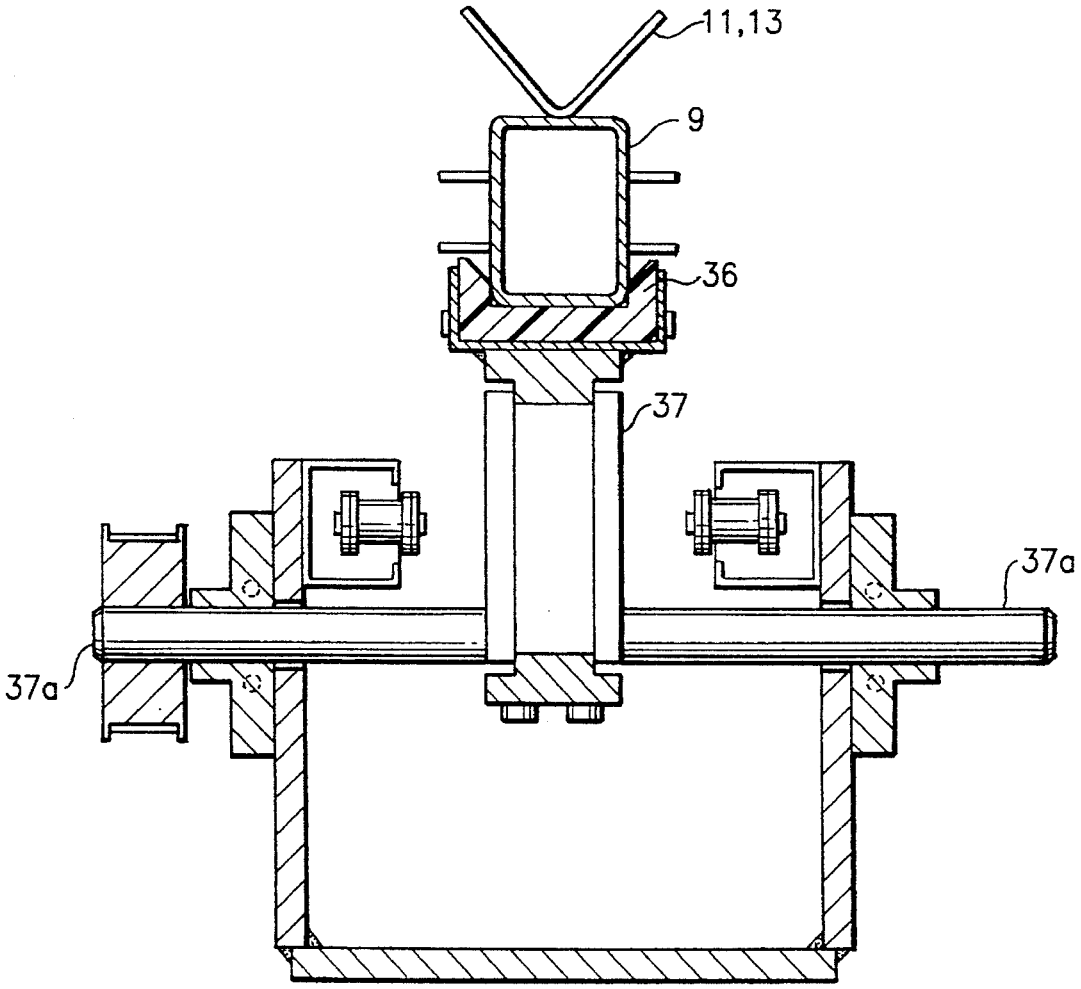
FIG. 7 shows the guide along which the holder may be moved in an axial direction.

FIG. 7 shows a sectional view of the mechanism for supporting the holder tube 9 to be moved. The mechanism comprises a plastic guide track 36 supported at two positions on its length by eccentrics (cams) 37 including cam arms 37*a* of which only one is shown in the drawing. These eccentrics 37 are driven by a common chain and are employed for moving the guide track 36 vertically.

Figure 2:
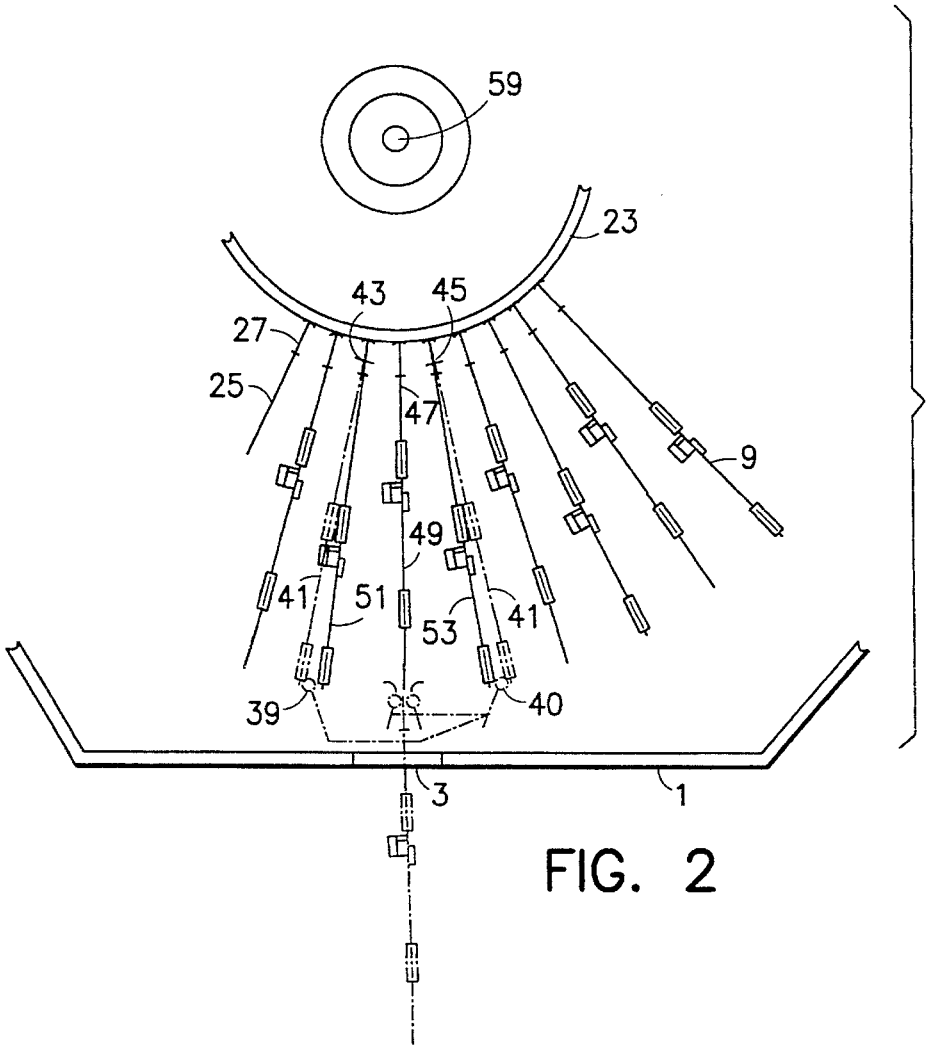
FIG. 2 shows a section of a top view of the bicycle holders with a diagrammatic representation therein of rollers for moving the ends of the holders on either one of the two sides of a holder apart.

FIG. 2 shows the mechanism for moving two holder tubes 9 apart by their ends which are remote from the frame 23, between which is disposed the holder tube that is to be moved through the doorway 3. When a bicycle holder 49 centered in front of the doorway 3 is moved out through the doorway 3, rollers 39 and 40 on either side of the holder 49 move holders 51 and 53, on both sides of holder 49, to positions 41, indicated by means of dotted lines, counteracting the working of leaf springs 43 and 45. In this position the intermediate holder 49 can be moved away from the pin 47 and the handlebars of the bicycle placed in the holder 49 can move freely between the holders 51 and 53 without being impeded by the handlebars of the bicycles placed in holders 51 and 53.

While the rollers are keeping the adjacent bicycle holders apart, additional rollers 55 and 57 are used for pressing against the intermediate bicycle holder 49 with a mechanism (not shown), so that the bicycle holder 49 positioned opposite to the doorway 3 remains positioned in the heart of the doorway during radial movement. After retracting the holder 49, the rollers 39 and 40 are returned to their original positions, so that the holders 51 and 53 regain their original radial positions.

Referring now to FIG. 7, while the holder 49 is being moved through the doorway 3, the holder is supported by the glide track 36 which is raised and lowered by means of the eccentrics 37 until the holder has reached the same horizontal plane as the pin 47. The holder tube 9 is then automatically moved onto the pin 47 and may be rotated along with the frame 23 as required.

Storing a bicycle is effected as follows: One or more codes are bought at a local selling point giving right of access to the bicycle storage apparatus. There are codes for different time durations, e.g. a day-ticket, a weekly ticket, a monthly ticket or a six-month ticket. Furthermore, there is a surcharge code for those who wish to fetch their bicycles once the validity of their storage code has elapsed.

Upon arrival, the user keys in on a keyboard the code known only to him. The door is opened automatically, after which a vacant bicycle holder is moved out. The bicycle is clamped in the bicycle holder after which the bicycle holder is retracted and the user leaves. Subsequently, a vacant bicycle holder is automatically moved in position behind the door.

To remove the bicycle, the user again keys in the code known to him. Once this has been done, the proper bicycle holder is rotated in position behind the door within 10 seconds, after which the door opens and the bicycle holder with the bicycle is moved out and the bicycle can be removed from the holder. Once the bicycle has been removed, the now vacant bicycle holder is retracted and the door is closed, thus terminating the storage cycle.

In the case of the validity of the code expiring, the bicycle can be regained by means of a surcharge code. It will be appreciated that other different methods are conceivable, such as the use of a machine producing a ticket after payment, which ticket states the number of a vacant bicycle holder, to be scanned by a scanner, after which the above operations are carried out.

I claim:

1. A bicycle storage apparatus for storing a plurality of bicycles, said apparatus, comprising:

a) a rotatable frame including a plurality of holders extending radially relative to a central axis, wherein the bicycles are fastened to said holders with front tires of the bicycle directed away from said central axis, said holders arranged for arranging the bicycles in two concentric inner and outer rows, the bicycles being alternately located in one and the other of said rows, at least said holders for the bicycles in the outer row being capable of transverse reciprocal movement thereby enabling unimpeded radial movement of a particular one of the bicycles from said inner row past the bicycles from said outer row; and b) at least one wall surrounding said rotatable frame, wherein said wall includes a lockable doorway through which the bicycles are radially inserted and removed.

2. A bicycle storage apparatus according to claim 1, wherein:

only one of said plurality of holders positioned in front of said doorway can be moved radially through said doorway at one time.

3. A bicycle storage apparatus according to claim 1, wherein:

each of said plurality of holders comprises a radial tube having a top side, an axial opening, at least one gutter-shaped holder coupled to said top side of said radial tube which receives a tire of a bicycle, and a clamp means coupled to said radial tube for clamping to a rod of the bicycle.

4. A bicycle storage apparatus according to claim 2, wherein:

each of said plurality of holders comprises a radial tube having a top side, an axial opening, at least one gutter-shaped holder coupled to said top side of said radial tube which receives a tire of a bicycle, and a clamp means coupled to said radial tube for clamping to a rod of the bicycle.

5. A bicycle storage apparatus according to claim 3, wherein:

said axial opening of each of said radial tubes is positioned near said central axis, said rotatable frame includes pins and springs, with said pins coupled to said rotatable frame by said springs, and said pins protruding radially from said rotatable frame, with said pins coupling to said radial tubes at said axial openings of said radial tubes, and said bicycle storage apparatus further comprising:

c) a slide track positioned perpendicular to said doorway between said doorway and said central axis, wherein said holder positioned in front of said doorway moves radially away from said pin over said slide track outward through said doorway.

6. A bicycle storage apparatus according to claim 4, wherein:

said axial opening of each of said radial tubes is positioned near said central axis, said rotatable frame includes pins and springs, with said pins coupled to said rotatable frame by said springs, and said pins protruding radially from said rotatable frame, with said pins coupling to said radial tubes at said axial openings of said radial tubes, and said bicycle storage apparatus further comprising:

c) a slide track positioned perpendicular to said doorway between said doorway and said central axis, wherein said holder positioned in front of said doorway moves radially away from said pin over said slide track outward through said doorway.

7. A bicycle storage apparatus according to claim 3, further comprising:

d) a set of rollers, wherein said rollers move holders located on either side of a holder located in front of said doorway transversely away from said holder located in front of said doorway, thereby counteracting said springs and allowing free radial movement of said holder in front of said doorway through said doorway.

8. A bicycle storage apparatus according to claim 4, further comprising:

d) a set of rollers, wherein said rollers move holders located on either side of a holder located in front of said doorway transversely away from said holder located in front of said doorway, thereby counteracting said springs and allowing free radial movement of said holder in front of said doorway through said doorway.

9. A bicycle storage apparatus according to claim 5, further comprising:

d) a set of rollers, wherein said rollers move holders located on either side of a holder located in front of said doorway transversely away from said holder located in front of said doorway, thereby counteracting said springs and allowing free radial movement of said holder in front of said doorway through said doorway.

10. A bicycle storage apparatus according to claim 6, further comprising:

d) a set of rollers, wherein said rollers move holders located on either side of a holder located in front of said doorway transversely away from said holder located in front of said doorway, thereby counteracting said springs and allowing free radial movement of said holder in front of said doorway through said doorway.

11. A bicycle storage apparatus according to claim 1, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

12. A bicycle storage apparatus according to claim 2, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

13. A bicycle storage apparatus according to claim 3, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

14. A bicycle storage apparatus according to claim 4, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

15. A bicycle storage apparatus according to claim 5, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

16. A bicycle storage apparatus according to claim 6, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

17. A bicycle storage apparatus according to claim 7, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

18. A bicycle storage apparatus according to claim 8, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

19. A bicycle storage apparatus according to claim 9, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

20. A bicycle storage apparatus according to claim 10, wherein:

said rotatable frame is rotatable around said central axis, said bicycle storage apparatus further comprising:

e) a drive means for rotating said frame around said axis; and f) a control means coupled to said drive means for unlocking said doorway and for controlling said drive means to rotate one of said holders in front of said doorway.

* * * * *